United States Patent [19]

Kaminaga

[11] Patent Number: 4,712,345

[45] Date of Patent: Dec. 15, 1987

[54] APPARATUS FOR CONNECTING CURTAIN WALL UNITS

[75] Inventor: Hiromitsu Kaminaga, Kurobe, Japan

[73] Assignee: Yoshida Kogyo, K. K., Tokyo, Japan

[21] Appl. No.: 855,390

[22] Filed: Apr. 24, 1986

[30] Foreign Application Priority Data

May 8, 1985 [JP] Japan ..... 60-66861[U]

[51] Int. Cl.[4] ..... E04B 1/40

[52] U.S. Cl. ..... 52/235; 52/509; 52/573

[58] Field of Search ..... 52/506, 509, 235, 573, 52/122.1, 127.6, 127.7, 127.8, 126.3, 126.5, 378, 704, 513, 483, 578, 582, 584, 474, 772

[56] References Cited

U.S. PATENT DOCUMENTS

| | | | |
|---|---|---|---|
| 2,853,870 | 9/1958 | Sinner et al. | 52/509 |
| 4,045,927 | 9/1977 | Diaz | 52/584 |
| 4,107,887 | 8/1978 | Wendt | 52/235 |
| 4,574,546 | 3/1986 | Gartner | 52/235 |

*Primary Examiner*—James L. Ridgill, Jr.

*Attorney, Agent, or Firm*—Hill, Van Santen, Steadman & Simpson

[57] ABSTRACT

Disclosed herein is an apparatus for connecting curtain wall units, which are juxtaposed vertically and horizontally in a vertical plane, at a portion where four corners of said curtain wall units gather with one another in such a manner as to permit in-plane displacement of said curtain wall units and restrict out-of-plane displacement, said apparatus comprising first coupling members fixed to an upper edge portion of horizontally adjacent curtain wall units, said first coupling members each having either of a projecting portion or a recessed portion adapted to be engaged with each other in such a manner that in-plane displacement thereof in the vertical plane is permitted, while out-of-plane displacement is restricted; second coupling members fixed to a lower edge portion of horizontally adjacent upper curtain wall units in such a manner as to be arranged in opposed relation with each other, said second coupling members each having the other of said projecting portion or said recessed portion; a connecting plate provided across said first coupling members having said projecting portion; through-holes formed through said first coupling members having said projecting portion; and bolts inserted through said through-holes for fixedly connecting said connecting plate with said second coupling members having said recessed portion with said first coupling members having said projecting portion sandwiched between said connecting plate and said second coupling members.

9 Claims, 5 Drawing Figures

APPARATUS FOR CONNECTING CURTAIN WALL UNITS

BACKGROUND OF THE INVENTION

The present invention relates to an apparatus for connecting curtain wall units constituting a unit type curtain wall as juxtaposed vertically and horizontally in a vertical plane.

In a conventional connecting apparatus as described in Japanese Patent Laid-open Publication No. 59-24052, a female member and a male member engaged with each other in a vertical plane are fixed to a lower end of an upper curtain wall unit and an upper end of a lower curtain wall unit each constituting the unit type curtain wall, respectively, so as to connect the upper and lower curtain wall units with each other in such a manner as to permit relative displacement in the plane.

According to the aforementioned known connecting apparatus, in-plane displacement between the upper and lower adjacent curtain wall units is absorbed therebetween, and the outer surfaces of the curtain wall units are flushed. However, the outer surfaces of horizontally adjacent curtain wall units cannot be flushed. As a result, the entire outer surface of the unit type curtain wall is out of alignment, resulting in poor appearance and there is a possibility of a reflective image on the entire outer surface being rendered out of order.

SUMMARY OF THE INVENTION

It is an object of the present invention to provide an apparatus for connecting curtain wall units juxtaposed vertically and horizontally in a vertical plane which permits the curtain wall units to be independently and correlatively moved in the plane, and may make the outer surfaces of the curtain wall units flash with each other.

According to the present invention, there is provided an apparatus for connecting curtain wall units, which are juxtaposed vertically and horizontally in a vertical plane, at a portion where four corners of said curtain wall units gather with one another in such a manner as to permit in-plane correlative displacement of said curtain wall units and restrict out-of-plane correlative displacement thereof, said apparatus comprising a pair of first coupling members fixed to upper edge portions of horizontally adjacent curtain wall units, respectively, said first coupling members each having either one of a projecting portion and a recessed portion adapted to be engaged with each other in such a manner that in-plane correlative displacement of the curtain wall units in the vertical and horizontal directions in said vertical plane is permitted, while out-of-plane correlative displacement thereof is restricted; a pair of second coupling members fixed to lower edge portions of a pair of horizontally adjacent upper-positioned curtain wall units, respectively, in such a manner as to be arranged in opposed relation with each other, said second coupling members each having the other of said projecting portion or said recessed portion; a connecting plate provided across either pair of said first or second coupling members; through-holes formed through either pair of said first or second coupling members, respectively; and bolts inserted through said through-holes for fixedly connecting said connecting plate and either pair of said first and said second coupling members with the other pair of coupling members sandwiched between said connecting plate and said former coupling members.

As is mentioned above, either pair of adjacent first or second coupling members are aligned in their respective out-of-plane positions by the connecting plate and the other pair of adjacent coupling members. Further, the recessed portions of either pair of adjacent first or second coupling members are respectively engaged with the projecting portions of the other pair of adjacent coupling members. Accordingly, the outer surfaces of the left lower, right lower, left upper and right upper curtain wall units are flushed in a plane to improve appearance and make a reflective image on the entire outer surface in order. In addition, each of the curtain wall units may be restrained from out-of-plane movement.

Further, since the bolts for connecting the connecting plate with the other pair of coupling members and operating to sandwich the former pair of coupling members therebetween are inserted through the through-holes of the former pair of coupling members, each of the curtain wall units may be independently moved in a plane, where the curtain wall units are juxtaposed vertically and horizontally, by the amount of play between the through-holes and the bolts, thereby absorbing in-plane correlative displacement created in the vertical and horizontal direction by thermal expansion and earthquake, etc. among the curtain wall units.

Furthermore, since either pair of adjacent first or second coupling members having the projecting portion and the other pair of adjacent coupling members having the recessed portion are connected by the bolts with each other, there is no possibility of both the pairs of adjacent first and second coupling members vertically disengaged from each other, thereby preventing the vertically adjacent curtain wall units from being disengaged from each other.

Other objects and features of the invention will be more fully understood from the following detailed description and appended claims when taken with the accompanying drawings.

DETAILED DESCRIPTION OF THE PREFERRED EMBODIMENTS

Figure 5:
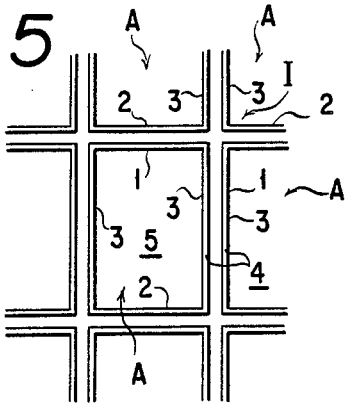
FIG. 5 is a schematic elevational view of a part of the unit type curtain wall. de

Referring to FIG. 5 which shows a schematic elevational view of a part of a unit type curtain wall, a plurality of curtain wall units A is vertically and horizontally juxtaposed to each other in a vertical plane. Each of the curtain wall units A is constituted of a rectangular frame 4 and a panel member such as a glass 5 mounted in the frame 4. The rectangular frame 4 includes an upper frame member 1, lower frame member 2 and right and left vertical frame members such as square timbers 3.

Figure 1:
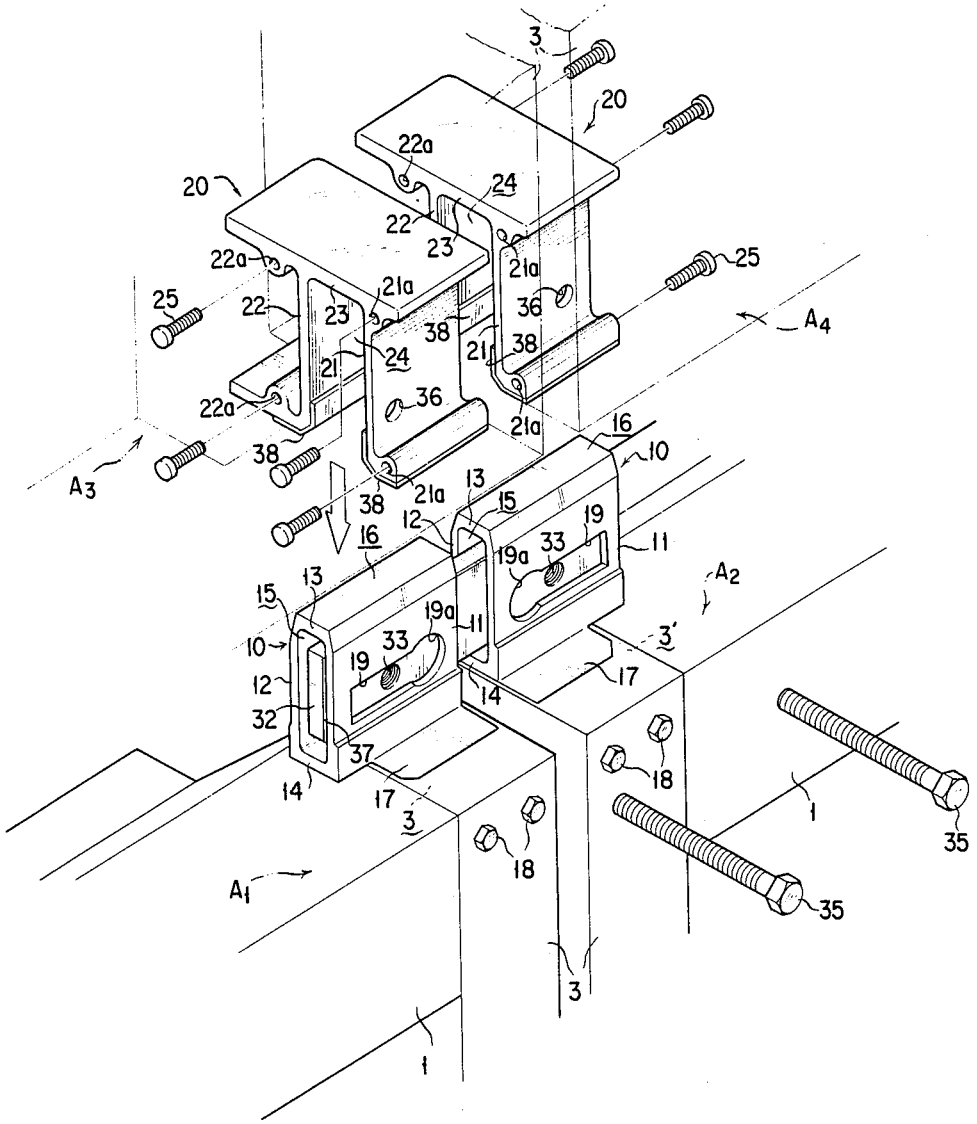
FIG. 1 is an exploded perspective view of a part as designated by I in FIG. 5.

Referring to FIG. 1 which shows an exploded perspective view of a portion indicated by I in FIG. 5, that is, a connecting portion at a portion where four corners of upper, lower, right and left curtain wall units meet with one another, each of first coupling members 10 is fixed to upper edge portions of a left lower curtain wall unit $A_1$ and a right lower curtain wall unit $A_2$, or upper end portions of the vertical frame members 3 as adjacently arranged, for example. Further, each of second coupling members 20 is fixed to lower edge portions of a left upper curtain wall unit $A_3$ and a right upper curtain wall unit $A_4$, or lower end portions of the vertical frame members 3 as adjacently arranged, for example.

Each of the first coupling members 10 is constituted of a projecting portion 16 having a horizontally extending hollow portion 15 as defined by inside and outside vertical walls 11 and 12 and upper and lower horizontal walls 13 and 14, and of a mount wall 17 as hookedly bent. The mount wall 17 is inserted into a hollow portion 3' of the vertical frame member 3, and is fixed by bolts 18 in such a manner that the projecting portion 16 is directed upwardly. The inside and outside vertical walls 11 and 12 are formed with horizontally elongated through-holes 19. Each of the through-holes 19 is formed with a circular large-diameter portion 19*a* at one end portion thereof to be engaged with a lifting hook when the curtain wall unit is lifted and mounted to a subject outer wall.

Each of the second coupling members 20 is formed with a recessed portion 24 as defined by inside and outside vertical walls 21 and 22 and an upper horizontal wall 23. The recessed portion 24 is opened downwardly and has such a shape and size as to mate with the projecting portion 16. The second coupling member 20 is inserted into a lower end portion of the hollow portion 3' of the vertical frame member 3, and is fixed by bolts 25.

Figure 2:
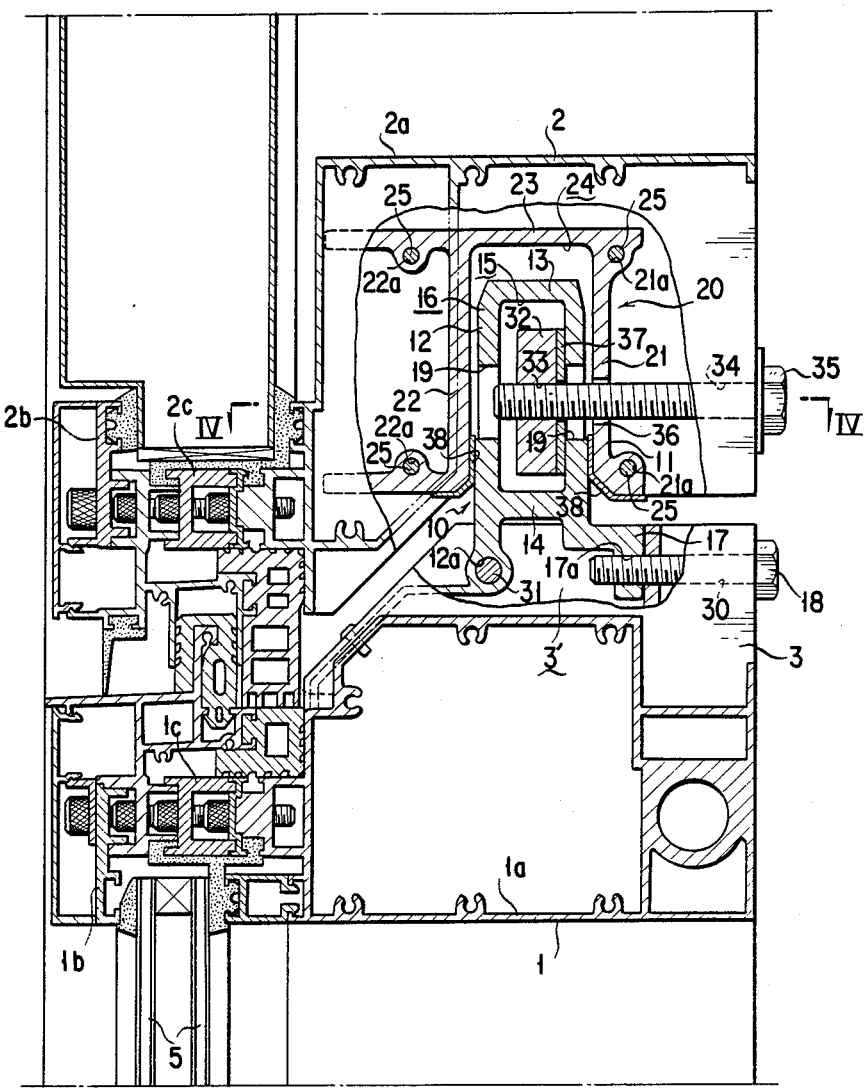
FIG. 2 is a vertical sectional view of a connecting portion of the adjacant curtain wall units according to the present invention.
Figure 3:
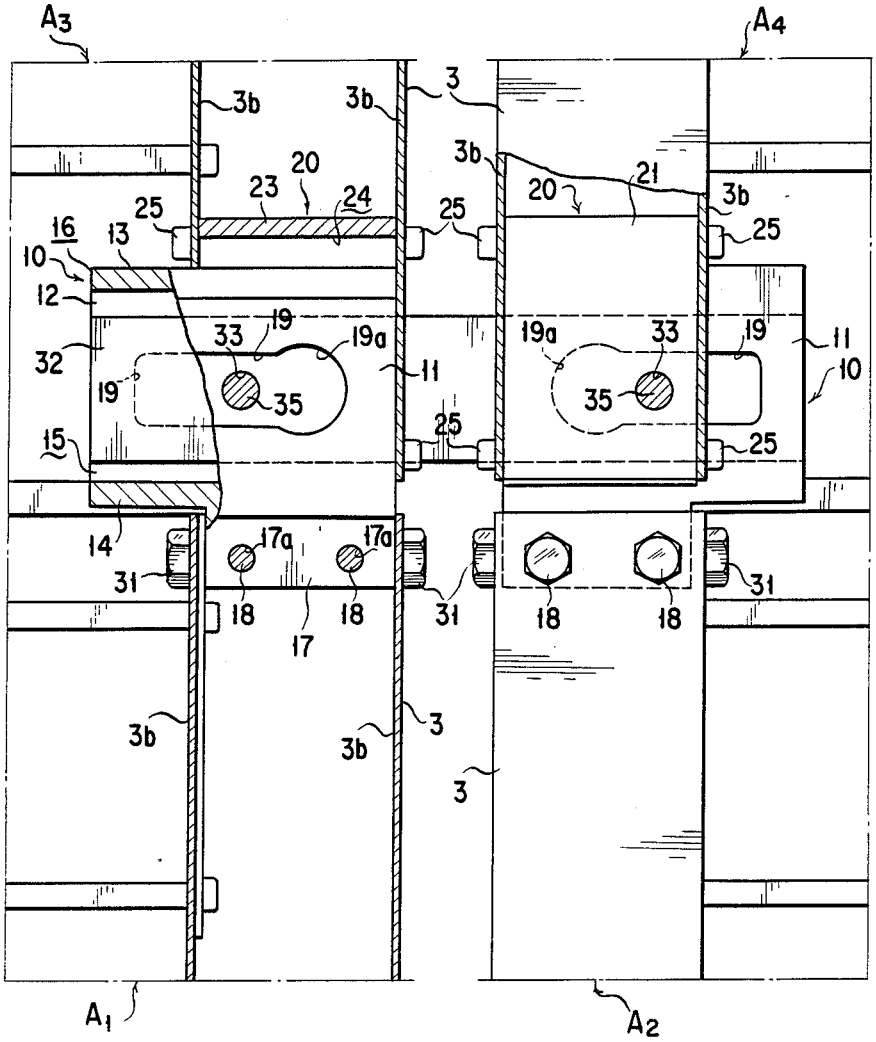
FIG. 3 is an enlarged front view of a part as designated by I in FIG. 5.
Figure 4:
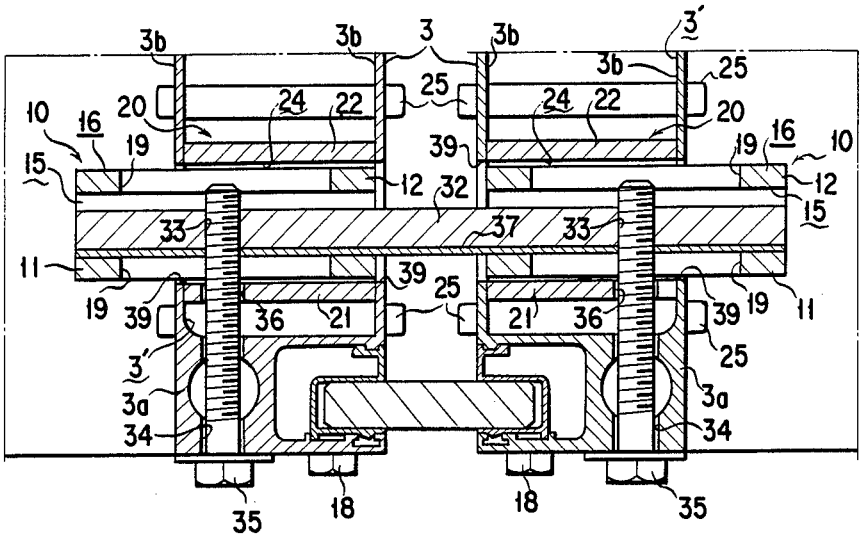
FIG. 4 is a cross section taken along the line IV—IV in FIG. 2.

As shown in FIG. 4, the vertical frame member 3 is an elongated material including the hollow portion 3' as defined by a thick-walled inside wall 3*a*, outside wall (not shown) and thin-walled side walls 3*b*. As shown in FIGS. 2 and 3, a lower portion of the outside vertical wall 12 of the first coupling member 10 and the mount wall 17 are engaged with the hollow portion 3'. The bolts 18 are inserted from holes 30 of the inside wall 3*a*, and are threadedly engaged with screw holes 17*a* of the mount wall 17. Bolts 31 are inserted through both the side walls 3*b*, and are threadedly engaged with screw holes 12*a* formed at the lower portion of the outside wall 12. Similarly, bolts 25 are inserted through both the side walls 3*b*, and are threadedly engaged with screw holes 21*a* and 22*a* formed through the inside and outside vertical walls 21 and 22 of the second coupling member 20.

The upper frame member 1 and the lower frame member 2 are in a heat insulating construction such that inside frame portions 1*a* and 2*a* are connected through heat insulating materials 1*c* and 2*c* to outside frame portions 1*b* and 2*b*, respectively.

Each of the projecting portions 16 of the first coupling members 10 is engaged with each of the recessed portions 24 of the second coupling members 20 to align the outer surfaces of the left upper, left lower, right upper and right lower curtain wall units $A_3$, $A_1$, $A_4$ and $A_2$.

A connecting plate 32 is inserted into both the hollow portions 15 of the first coupling members 10 in such a manner as to be laid thereacross. The connecting plate 2 is formed with screw holes 33 to be threadedly engaged with the bolts 35 at both ends in the longitudinal direction thereof. The screw holes 33 are opened to the through-holes 19. As shown in FIG. 4, the bolts 35 are inserted from through-holes 34 of the inside walls 3*a* of the vertical frame members 3 of the left and right upper curtain wall units $A_3$ and $A_4$, and are threadedly engaged from holes 36 formed through the inside vertical walls 21 of the second coupling members 20 through the through-holes 19 into the screw holes 33. There are provided low-friction sheets 37 attached to the inside vertical walls 11 of the adjacent first coupling members 10, and the connecting plate 32 is brought into tight contact with the low-friction sheets 37 by the bolts 35, thus sandwiching the first coupling members 10 between the connecting plate 32 and the second coupling members 20. Similarly, there are provided low-friction sheets 38 attached to the inside and outside vertical walls 21 and 22 of the second coupling member 20. The low-friction sheets 38 are brought into contact with the inside and outside vertical walls 11 and 12 of the first coupling member 10.

The side walls 3*b* of the vertical frame member 3 of the left and right upper curtain wall units $A_3$ and $A_4$ are formed with recesses 39 to be engaged with the projecting portions 16 of the first coupling members 10.

Thus, the adjacent first coupling members 10 are connected with each other by the connecting plate 32 and the adjacent second coupling members 20, and the out-of-plane positions of the first and second coupling members 10 and 20 are aligned. Further, as the projecting portions 16 of the adjacent first coupling members 10 are engaged with the recessed portions 24 of the adjacent second coupling members 20 to restrict the out-of-plane positions of the first and second coupling members 10 and 20, the outer surfaces of the left upper, left lower, right upper and right lower curtain wall units $A_3$, $A_1$, $A_4$ and $A_2$ are flushed with each other to obtain a flush outer surface of the unit type curtain wall unit as a whole.

While the connecting plate 32 and the second coupling members 20 are fixed by the bolts 35 to the vertical frame members 3 of the left and right upper curtain wall units $A_3$ and $A_4$, the bolts 35 are displaceable vertically and horizontally relative to the first coupling members 10 owing to the through-holes 19. As a result, each of the curtain wall units may be independently moved in their plane, and in-plane displacement created by thermal expansion and earthquake, etc. may be absorbed among the curtain wall units.

In the aforementioned preferred embodiment, the first coupling members 10 are provided at the upper edge portion of the left and right lower curtain wall units $A_1$ and $A_2$, and the second coupling members 20 are provided at the lower edge portion of the left and right upper curtain wall units $A_3$ and $A_4$ However, the first and second coupling members 10 and 20 may be provided in such a manner as reversed to the above.

Further, although the connecting plate 32 is inserted into the hollow portions 15 of the adjacent first coupling members 10 in such a manner as to be laid thereacross, the connecting plate 32 may be provided across depending portions integrally formed with the projecting portions 10 in a modified embodiment.

In other words, the connecting plate 32 is laid across the adjacent first coupling members 10, and is connected with the second coupling members 20 by the bolts 35 passing through the through-holes 19 of the first coupling members 10 with the first coupling members 10 sandwiched between the connecting plate 32 and the second coupling members 20.

What is claimed is:

1. An apparatus for connecting curtain wall units, which are juxtaposed vertically and horizontally in a vertical plane, at a portion where four corners of said curtain wall units gather with one another in such a manner as to permit individual in-plane correlative displacement of each of said curtain wall units and restrict out-of-plane correlative displacement thereof, said apparatus comprising a pair of first coupling members fixed to upper edge portions of a pair of horizontally adjacent lower positioned curtain wall units, respectively, said first coupling members each having either one of a projecting portion and a recessed portion adapted to be engaged with each other in such a manner that in-plane correlative displacement of the curtain wall units in the vertical and horizontal directions in said vertical plane is permitted, while out-of-plane correlative displacement thereof is restricted; a pair of second coupling members fixed to lower edge positioned curtain wall units, respectively, in such a manner as to be arranged in opposed relation with said first coupling members, said second coupling members each having the other of said projecting portion or recessed portion; a connecting plate provided across each of the pairs of said first and second coupling members; through-holes formed through one of said pairs of said first or second coupling members, respectively; and bolts inserted through said through-holes for fixedly connecting said connecting plate and the other of said pairs of said first and second coupling members with the one pair of coupling members sandwiched between said connecting plate and said other pair of coupling members, said through-holes having a size permitting vertical and horizontal movement of said bolts.

2. An apparatus according to claim 1, wherein each of said first coupling members has a mount wall to be inserted into a hollow portion bored in a vertical frame member of said lower curtain wall units and be fixed by a bolt in such a manner that said projecting or recessed portion is directed upwardly.

3. An apparatus according to claim 1, wherein each of said through-holes is formed with a circular large-diameter portion to be engaged with a curtain wall lifting hook at one end portion thereof.

4. An apparatus according to claim 1, wherein each of said second coupling members is inserted into a hollow portion bored in a vertical frame member of said upper curtain wall units, and is fixed by a bolt in such a manner that said recessed or projecting portion is directed downwardly.

5. An apparatus according to claim 1, wherein said connecting plate is formed with screw holes threadedly engaged with said bolts at both ends in a longitudinal direction thereof, said screw holes opening to said through-holes.

6. An apparatus according to claim 1, further comprising a low-friction sheet attached to an interior-side wall of inside vertical walls of each of the pair of said first or second adjacent coupling members which have said projecting portions, said connecting plate being in tight contact with said low-friction sheet.

7. An apparatus according to claim 1, further comprising low-friction sheets attached to interior-side and outdoor-side vertical walls of each of the pair of adjacent coupling members which have said recessed portions, said low-friction sheets being in contact with interior- and outdoor-side of outer vertical walls of each of this said pair of adjacent coupling members.

8. An apparatus according to claim 1, wherein said projecting portion has a horizontally extending hollow portion.

9. An apparatus according to claim 8, wherein said connecting plate is inserted in both of said hollow portions in such a manner as to be laid thereacross.

* * * * *